US008408888B2

(12) United States Patent
Nishikawa et al.

(10) Patent No.: US 8,408,888 B2
(45) Date of Patent: Apr. 2, 2013

(54) SCROLL COMPRESSOR HAVING RELIEF PORTS TO OPEN FIRST AND SECOND COMPRESSION CHAMBERS

(75) Inventors: Yoshihiro Nishikawa, Sakai (JP); Toru Sugiyama, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 721 days.

(21) Appl. No.: 12/600,078

(22) PCT Filed: Apr. 14, 2008

(86) PCT No.: PCT/JP2008/000978

§ 371 (c)(1),
(2), (4) Date: Nov. 13, 2009

(87) PCT Pub. No.: WO2008/142825

PCT Pub. Date: Nov. 27, 2008

(65) Prior Publication Data

US 2010/0221133 A1 Sep. 2, 2010

(30) Foreign Application Priority Data

May 17, 2007 (JP) ..... 2007-131463

(51) Int. Cl.

*F03C 2/00* (2006.01)
*F03C 4/00* (2006.01)
*F04C 2/00* (2006.01)

(52) U.S. Cl. ..... 418/15; 418/55.1; 418/55.5; 418/57; 417/307; 417/310

(58) Field of Classification Search ..... 418/15, 418/55.1–55.6, 57, 270; 417/310, 301, 307, 417/308, 410.5, 440

See application file for complete search history.

(56) References Cited

U.S. PATENT DOCUMENTS

| | | | | |
|---|---|---|---|---|
| 4,389,171 | A * | 6/1983 | Eber et al. | 418/15 |
| 4,714,415 | A * | 12/1987 | Mizuno et al. | 418/55.1 |
| 4,774,816 | A * | 10/1988 | Uchikawa et al. | 418/15 |
| 4,818,195 | A | 4/1989 | Murayama et al. | |
| 5,855,475 | A | 1/1999 | Fujio et al. | |
| 7,393,190 | B2 * | 7/2008 | Lee et al. | 418/55.1 |
| 2006/0099098 | A1 * | 5/2006 | Lee et al. | 418/55.1 |

FOREIGN PATENT DOCUMENTS

| | | | |
|---|---|---|---|
| JP | 62-197684 | A | 9/1987 |
| JP | 63-205482 | A | 8/1988 |
| JP | 04-255589 | A | 9/1992 |
| JP | 09-170574 | A | 6/1997 |
| JP | 09-217691 | A | 8/1997 |
| JP | 2001-200795 | A | 7/2001 |

* cited by examiner

*Primary Examiner* — Theresa Trieu
(74) *Attorney, Agent, or Firm* — Global IP Counselors

(57) ABSTRACT

A compression mechanism is provided with a first relief port opening only to a first compression chamber, a second relief port opening only to a second compression chamber, and a third relief port which can open to both of the first compression chamber and the second compression chamber.

13 Claims, 8 Drawing Sheets

SCROLL COMPRESSOR HAVING RELIEF PORTS TO OPEN FIRST AND SECOND COMPRESSION CHAMBERS

CROSS-REFERENCE TO RELATED APPLICATIONS

This U.S. National stage application claims priority under 35 U.S.C. §119(a) to Japanese Patent Application No. 2007-131463, filed in Japan on May 17, 2007, the entire contents of which are hereby incorporated herein by reference.

TECHNICAL FIELD

The present invention relates to scroll compressors, and more particularly relates to an over-compression prevention measure.

BACKGROUND ART

Conventionally, scroll compressors have been widely known which are used for, e.g., refrigeration systems, etc., to compress fluid, such as refrigerant.

Japanese Patent Publication No. 9-170574 describes a scroll compressor of this type. This scroll compressor includes a compression mechanism having a so-called asymmetric scroll structure. For this compression mechanism, a fluid compression chamber is formed by allowing a fixed scroll wrap to mesh with an orbiting scroll wrap. The compression chamber is sectioned into a first compression chamber facing the outer peripheral surface of the orbiting scroll wrap and a second compression chamber facing the inner peripheral surface of the orbiting scroll wrap. Furthermore, a suction port for leading fluid to the compression chambers is formed near the outer peripheral surface of the compression mechanism. A discharge port for discharging fluid compressed in the compression chambers to the outside (discharge space) is formed in the middle of the compression mechanism. For this scroll compression mechanism, an orbiting scroll eccentrically rotates relative to a fixed scroll. Consequently, each compression chamber gradually moves inwardly from the vicinity of the outer periphery of the compression mechanism so that its volume decreases, resulting in fluid compressed in the compression chamber.

Here, the volume ratio (compression ratio) of such a scroll compressor is set at a predetermined constant value to meet rated operating conditions of a refrigeration system, etc. Therefore, for example, under operating conditions where the pressure differential between high and low pressure regions of a refrigeration system is relatively small, a phenomenon in which refrigerant is excessively compressed by a compression mechanism, i.e., so-called over-compression, occurs. This significantly reduces compression efficiency.

To address the above-mentioned problem, in the scroll compressor of Japanese Patent Publication No. 9-170574, the compression mechanism is provided with relief ports in order to avoid such over-compression. More specifically, in the compression mechanism, an end plate for a fixed scroll is provided with six relief ports (bypass ports). Three of these relief ports correspond to the first compression chamber, and the other three relief ports correspond to the second compression chamber. Each relief port is provided with an openable and closable relief valve. For this compression mechanism, for example, under operating conditions where the pressure differential between the high and low pressure regions is small, the relief port is opened. As a result, refrigerant that is being compressed in each compression chamber is delivered through the associated relief ports to the outside (high-pressure space), thereby avoiding the above-described over-compression.

SUMMARY OF THE INVENTION

Technical Problem

Here, when a compression mechanism is provided with relief ports as described above, a void space that does not contribute to fluid compression is formed in each relief port. Accordingly, for example, during such rated operation that allows the relief valve to close, this void space forms a so-called dead volume, resulting in reduced compression efficiency. In particular, when many relief ports are disposed to correspond to each compression chamber as in the above-mentioned Japanese Patent Publication No. 9-170574, the dead volume accordingly increases. This increase leads to significantly reduced compression efficiency.

The present invention has been made in view of the foregoing point, and an object thereof is to provide a scroll compressor that can reduce the dead volume arising from relief ports and allows fluid in each compression chamber to be reliably delivered through the associated relief ports.

Solution to the Problem

A first aspect of the invention is directed to a scroll compressor including a compression mechanism (20) including a fixed scroll (21), and an orbiting scroll (22) eccentrically rotating relative to the fixed scroll (21). A first compression chamber (24*a*) facing an outer peripheral surface of a wrap (22*b*) of the orbiting scroll (22), and a second compression chamber (24*b*) facing an inner peripheral surface of a wrap (22*b*) of the orbiting scroll (22) are formed by allowing a scroll wrap (21*b*) of the fixed scroll (21) to mesh with the scroll wrap (22*b*) of the orbiting scroll (22). An end plate (21*a*) of the fixed scroll (21) is provided with: a discharge port (25) formed in a middle part of the end plate (21*a*) to discharge fluid compressed in the compression chambers (24*a*, 24*b*) to a discharge space (28); a plurality of relief ports (31*a*, 31*b*, 32*a*, 32*b*, 33) formed outside the discharge port (25) and each having one end that is open to the associated compression chambers (24*a*, 24*b*) and the other end connected with the discharge space (28); and relief valves (37, 38, 39) for opening and closing the associated relief ports (31*a*, 31*b*, 32*a*, 32*b*, 33). In the scroll compressor, the plurality of relief ports include: a first relief port (31*a*, 31*b*) configured to open only to the first compression chamber (24*a*) of both the compression chambers (24*a*, 24*b*); a second relief port (32*a*, 32*b*) configured to open only to the second compression chamber (24*b*) of both the compression chambers (24*a*, 24*b*); and a third relief port (33) configured so that eccentric rotation of the orbiting scroll (22) allows the third relief port (33) to open to the first compression chamber (24*a*) and the second compression chamber (24*b*) alternately.

In the compression mechanism (20) according to the first aspect of the invention, eccentric rotation of the orbiting scroll (22) allows the compression chambers (24*a*, 24*b*) to move inwardly from the vicinity of the outer periphery of the compression mechanism (20) so that the volume of the compression mechanism (20) decreases. As a result, fluid is compressed in the compression chambers (24*a*, 24*b*). When the compression chambers (24*a*, 24*b*) in which fluid has been compressed communicate with the discharge port (25), this fluid is discharged through the discharge port (25) into the discharge space (28). The discharged fluid is utilized for, e.g., a vapor compression refrigeration cycle of a refrigeration system.

In the aspect of the present invention, the end plate (21*a*) of the fixed scroll (21) is provided with the first through third relief ports (31*a*, 31*b*, 32*a*, 32*b*, 33). Here, in the aspect of the present invention, a first relief port (31*a*, 31*b*) is configured to open only to the first compression chamber (24*a*), and a second relief port (32*a*, 32*b*) is configured to open only to the second compression chamber (24*b*). On the other hand, a third relief port (33) is configured so that eccentric rotation of the orbiting scroll (22) allows the third relief port (33) to open to both of the first compression chamber (24*a*) and the second compression chamber (24*b*). Therefore, in the compression mechanism (20) of the aspect of the present invention, for example, when fluid in the first compression chamber (24*a*) is excessively compressed, this fluid can be released through both of the first relief port (31*a*, 31*b*) and the third relief port (33) to the discharge chamber (28). Furthermore, for example, when fluid in the second compression chamber (24*b*) is excessively compressed, this fluid can be released through both of the second relief port (32*a*, 32*b*) and the third relief port (33) to the discharge chamber (28). In view of the above, in the aspect of the present invention, a sufficient amount of excessively compressed fluid can be delivered from both of the compression chambers (24*a*, 24*b*).

In the aspect of the present invention, for example, unlike the above-described scroll compressor of Japanese Patent Publication No. 9-170574, the third relief port (33) is used as a passage for releasing fluid from the two compression chambers (24*a*, 24*b*). Specifically, in Patent Document 1, a plurality of relief ports are provided to correspond only to a first compression chamber, and a plurality of relief ports are provided to correspond only to a second compression chamber. On the other hand, in the aspect of the present invention, the third relief port (33) is used for both of the compression chambers (24*a*, 24*b*). This can reduce the total number of relief ports (31*a*, 31*b*, 32*a*, 32*b*, 33) as compared with Patent Document 1. For this reason, the total volume of void spaces arising from the relief ports (31*a*, 31*b*, 32*a*, 32*b*, 33) can be reduced, thereby reducing the dead volumes of the compression chambers (24*a*, 24*b*).

According to a second aspect of the invention, in the scroll compressor of the first aspect of the invention, the first relief port (31*a*, 31*b*) may be disposed near an inner peripheral surface of the wrap (21*b*) of the fixed scroll (21), the second relief port (32*a*, 32*b*) may be disposed near an outer peripheral surface of the wrap (21*b*) of the fixed scroll (21), and the third relief port (33) may be disposed to open midway between the inner and outer peripheral surfaces of the wrap (21*b*) of the fixed scroll (21).

In the second aspect of the invention, the first relief port (31*a*, 31*b*) is disposed near the inner peripheral surface of the wrap (21*b*) of the fixed scroll (21). Therefore, even when the orbiting scroll (22) eccentrically rotates relative to the fixed scroll (21), the first relief port (31*a*, 31*b*) communicates only with the first compression chamber (24*a*) facing the inner peripheral surface of the wrap (21*b*) and does not communicate with the second compression chamber (24*b*). In view of the above, when fluid is excessively compressed in the first compression chamber (24*a*), this fluid is delivered through the first relief port (31*a*, 31*b*) to the discharge chamber (28) with reliability.

Moreover, the second relief port (32*a*, 32*b*) is disposed near the outer peripheral surface of the wrap (21*b*) of the fixed scroll (21). Therefore, even when the orbiting scroll (22) eccentrically rotates relative to the fixed scroll (21), the second relief port (32*a*, 32*b*) communicates only with the second compression chamber (24*b*) facing the outer peripheral surface of the wrap (21*b*) and does not communicate with the first compression chamber (24*a*). In view of the above, when fluid is excessively compressed in the second compression chamber (24*b*), this fluid is delivered through the second relief port (32*a*, 32*b*) to the discharge chamber (28) with reliability.

Furthermore, the third relief port (33) is disposed midway between the inner and outer peripheral surfaces of the wrap (21*b*) of the fixed scroll (21). Therefore, eccentric rotation of the orbiting scroll (22) allows the wrap (22*b*) of the orbiting scroll (22) to repeatedly reciprocate radially across the third relief port (33). Thus, the third relief port (33) communicates with the first compression chamber (24*a*) and the second compression chamber (24*b*) alternately. In view of the above, when fluid in one or both of the compression chambers (24*a*, 24*b*) is excessively compressed, this fluid is delivered through the third relief port (33) to the discharge chamber (28) with reliability.

According to a third aspect of the invention, in the scroll compressor of the second aspect of the invention, the first relief port (31*a*, 31*b*) may be located so as to be able to open to the first compression chamber (24*a*) communicating with the discharge port (25), and the second relief port (32*a*, 32*b*) may be located so as to be able to open to the second compression chamber (24*b*) communicating with the discharge port (25).

In the third aspect of the invention, the first relief port (31*a*, 31*b*) is provided so as to be able to open to the first compression chamber (24*a*) communicating with the discharge port (25). Therefore, when the first compression chamber (24*a*) communicates with the discharge port (25) to discharge fluid through the discharge port (25), this fluid can be delivered also through the first relief port (31*a*, 31*b*) at the same time. Here, the fluid delivered through the first relief port (31*a*, 31*b*) is high pressure fluid when a compression stroke is completed. In view of the above, in the aspect of the present invention, the advantage of decompression resulting from the delivery of fluid from the first compression chamber (24*a*), i.e., the advantage of reducing over-compression, is enhanced, for example, as compared with the case where fluid immediately after the start of compression or fluid that is being compressed is delivered through the first relief port.

Similarly, in the aspect of the present invention, the second relief port (32*a*, 32*b*) opens to the second compression chamber (24*b*) communicating with the discharge port (25). Therefore, when the second compression chamber (24*b*) communicates with the discharge port (25) so that fluid is discharged through the discharge port (25), this fluid can be delivered also through the second relief port (32*a*, 32*b*) at the same time. In view of the above, in the aspect of the present invention, the advantage of reducing over-compression results from the delivery of fluid from the second compression chamber (24*b*), and is also enhanced.

According to a fourth aspect of the invention, in the scroll compressor of the second or third aspect of the invention, the third relief port (33) may be disposed closer to the discharge port (25) than the first relief port (31*a*, 31*b*) and the second relief port (32*a*, 32*b*).

In the fourth aspect of the invention, the third relief port (33) may be located closer to the discharge port (25) than the first relief port (31*a*, 31*b*) and the second relief port (32*a*, 32*b*). Specifically, since the distance from the third relief port (33) to the discharge port (25) is shorter than that from the first relief port (31*a*, 31*b*) or the second relief port (32*a*, 32*b*) to the discharge port (25), fluid in the vicinity of the discharge port (25) is delivered to the third relief port (33). Thus, for the compression mechanism (20) of the aspect of the present invention, extremely high pressure fluid when the compression stroke is completed can be delivered through the third relief port (33). In view of the above, in the aspect of the present invention, the advantage of reducing over-compression results from the delivery of fluid from each compression chamber (24*a*, 24*b*), and is enhanced.

According to a fifth aspect of the invention, in the scroll compressor of any one of the first through fourth aspect of the invention, the end plate (21*a*) of the fixed scroll (21) may include multiple adjacent ones of at least one of the first through third relief ports (31*a*, 31*b*, 32*a*, 32*b*, 33), a relief channel (35, 36) may be formed in the end plate (21*a*) to straddle a part of the end plate (21*a*) between outlet ends of each adjacent pair of the relief ports (31*a*, 31*b*, 32*a*, 32*b*), and a corresponding one of the relief valves (37, 38) can open and close the relief channel (35, 36).

In the fifth aspect of the invention, the end plate (21*a*) of the fixed scroll (21) may include multiple adjacent ones of at least one of the first through third relief ports (31*a*, 31*b*, 32*a*, 32*b*, 33). A specific example will be given below. For example, two first relief ports (31*a*, 31*b*) are disposed in the end plate (21*a*) of the fixed scroll (21) to be adjacent to each other. A relief channel (35) is disposed to straddle a part of the end plate (21*a*) between the outlet ends of the first relief ports (31*a*, 31*b*), and is provided with a relief valve (37). In the structure of this example, when fluid in the first compression chamber (24*a*) is excessively compressed, this fluid flows into the two first relief ports (31*a*, 31*b*), the respective fluid streams in the two first relief ports (31*a*, 31*b*) join each other, and is then delivered to the discharge chamber (28). In other words, the relief channel (35) forms a part of a fluid release passage used for both the two relief ports (31*a*, 31*b*). In view of the above, in the aspect of the present invention, the void space that does not contribute to compression of fluid, i.e., the dead volume, is reduced, for example, as compared with the case where the first relief ports (31*a*, 31*b*) are formed as independent passages. Furthermore, in the aspect of the present invention, the relief channel (35) used for a plurality of relief ports (31*a*, 31*b*) is opened and closed by the relief valve (37). In other words, in the aspect of the present invention, the plurality of relief ports (31*a*, 31*b*) are opened and closed by a smaller number of relief valves (37) than the number of the relief ports (31*a*, 31*b*). Accordingly, the number of relief valves (37) is reduced, for example, as compared with the case where each first relief port (31*a*, 31*b*) is provided with a relief valve (37).

According to a sixth aspect of the invention, in the scroll compressor of any one of the first through fifth aspects of the invention, when a total volume of spaces between inlet ends of the relief ports (31*a*, 31*b*, 32*a*, 32*b*, 33) and the associated closed relief valves (37, 38, 39) is Vr, and a suction volume of the compression mechanism (20) is Vs, the ratio of Vr to Vs may be equal to or less than 0.01.

In the sixth aspect of the invention, the sum Vr of void spaces (dead volumes) between the inlet ends of the relief ports (31*a*, 31*b*, 32*a*, 32*b*, 33) and the associated closed relief valves (37, 38, 39) is equal to or less than 1% of the suction volume (displacement) Vs of the compression mechanism (20). This can minimize a reduction in the compression efficiency of the compression mechanism (20) due to such void spaces as described above.

Advantages of the Invention

In an aspect of the present invention, the following elements are provided: a first relief port (31*a*, 31*b*) opening only to a first compression chamber (24*a*); a second relief port (32*a*, 32*b*) opening only to a second compression chamber (24*b*); and a third relief port (33) that can open to both of the compression chambers (24*a*, 24*b*). Excessively compressed fluid is delivered through the relief ports (31*a*, 31*b*, 32*a*, 32*b*, 33). In this manner, according to the present invention, a sufficient amount of refrigerant can be delivered from both of the first compression chamber (24*a*) and the second compression chamber (24*b*), thereby efficiently avoiding over-compression. Here, the third relief port (33) is used as a relief port for both of the first compression chamber (24*a*) and the second compression chamber (24*b*). This can decrease the number of relief ports. Consequently, the dead volume arising from the relief ports (31*a*, 31*b*, 32*a*, 32*b*, 33) can be reduced. This can prevent, for example, a reduction in compression efficiency during rated operation. A reduction in the number of relief ports can simplify the structure of the compression mechanism (20) and thus reduce the number of man-hours and the production cost.

According to the second aspect of the invention, the first relief port (31*a*, 31*b*) may be disposed near the inner peripheral surface of the wrap (21*b*) of the fixed scroll (21), the second relief port (32*a*, 32*b*) may be disposed near the outer peripheral surface of the wrap (21*b*), and the third relief port (33) may be disposed to open midway between the inner and outer peripheral surfaces of the wrap (21*b*). This relatively simple structure can provide the first aspect of the invention.

In particular, in the third aspect of the invention, the first relief port (31*a*, 31*b*) can communicate with the first compression chamber (24*a*) connected with the discharge port (25), and the second relief port (32*a*, 32*b*) can communicate with the second compression chamber (24*b*) connected with the discharge port (25). Thus, relatively high pressure fluid can be delivered through the first relief port (31*a*, 31*b*) and the second relief port (32*a*, 32*b*). This can sufficiently reduce over-compression in both the compression chambers (24*a*, 24*b*).

In addition, in the fourth aspect of the invention, the third relief port (33) may be disposed closer to the discharge port (25) than the first relief port (31*a*, 31*b*) and the second relief port (32*a*, 32*b*). Therefore, extremely high pressure fluid can be delivered through the third relief port (33). This can further reduce over-compression in both the compression chambers (24*a*, 24*b*).

Furthermore, in the fifth aspect of the invention, a relief channel (35, 36) may be formed to straddle a part of the end plate (21*a*) between each adjacent pair of the relief ports (31*a*, 31*b*, 32*a*, 32*b*), and a corresponding one of relief valves (37, 38) can open and close the relief channel (35, 36). Therefore, these relief ports (31*a*, 31*b*, 32*a*, 32*b*) can be opened and closed by a smaller number of relief valves (37, 38) than the number of the adjacent relief ports (31*a*, 31*b*, 32*a*, 32*b*). This can reduce the number of parts. Moreover, the dead volume can be reduced as compared with the case where relief ports (31*a*, 31*b*, 32*a*, 32*b*) are independently provided. This can more reliably prevent, for example, a reduction in compression efficiency during rated operation.

Furthermore, in the sixth aspect of the invention, the ratio Vr/Vs of the total volume Vr of void spaces in the relief ports (31*a*, 31*b*, 32*a*, 32*b*, 33) to the suction volume Vs of the compression mechanism (20) is equal to or less than 1%. In view of the above, the influence of the dead volume of the compression mechanism (20) can be reduced. This can increase, for example, compression efficiency during rated operation.

DESCRIPTION OF EMBODIMENTS

Embodiments of the present invention will be more particularly described hereinafter with reference to the drawings.

A scroll compressor (10) of this embodiment is provided, for example, somewhere in a refrigerant circuit that operates in a vapor compression refrigeration cycle of an air conditioning system, and compresses refrigerant.

Figure 1:
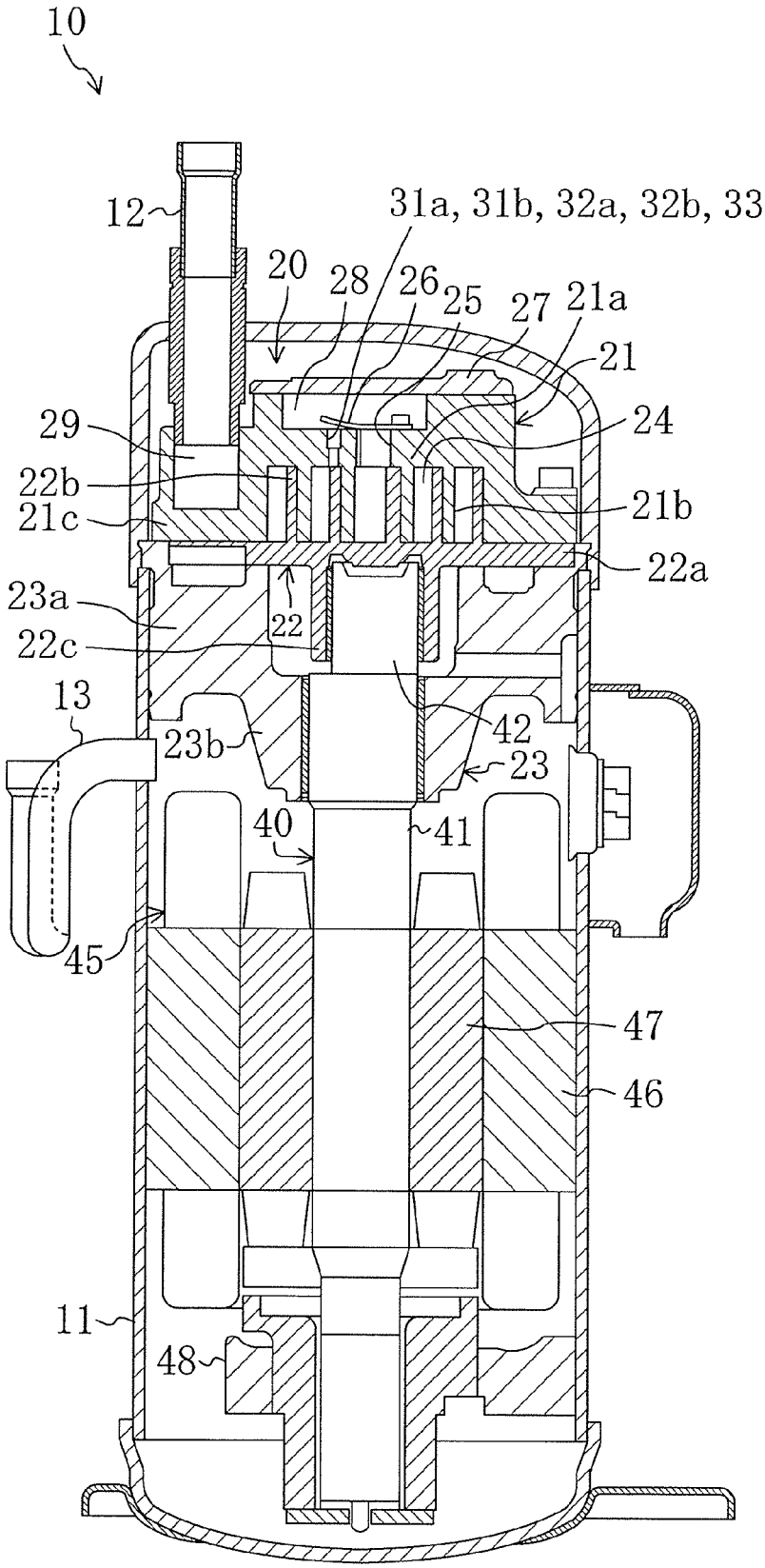
FIG. 1 is a longitudinal cross-sectional view illustrating an overall scroll compressor according to an embodiment.

As illustrated in FIG. 1, the scroll compressor (10) is a so-called hermetic scroll compressor. This scroll compressor (10) includes a casing (11) formed as a vertically long cylindrical hermetic shell. A compression mechanism (20) for compressing refrigerant, and a motor (45) for driving the compression mechanism (20) are contained in this casing (11). This motor (45) is disposed below the compression mechanism (20), and is coupled to the compression mechanism (20) through a drive shaft (40) forming a rotation axis.

A suction pipe (12) is attached to the casing (11) to pass through the top of the casing (11). This suction pipe (12) is connected at its downstream end with the compression mechanism (20). A discharge pipe (13) is attached to the casing (11) to pass through the body of the casing (11). The downstream end of the discharge pipe (13) is opened in the casing (11) and between the compression mechanism (20) and the motor (45).

The drive shaft (40) includes a main shaft portion (41) and an eccentric portion (42), and forms a crank. The eccentric portion (42) is formed to have a smaller diameter than the main shaft portion (41), and is placed upright on the upper end surface of the main shaft portion (41). The eccentric portion (42) is eccentric to the center of the main shaft portion (41) by a predetermined distance, and forms an eccentric pin.

A lower bearing member (48) is fixed in the vicinity of the lower end of the body of the casing (11). The lower bearing member (48) rotatably supports a lower end part of the main shaft portion (41) of the drive shaft (40). Although not illustrated, a vertically extending oil supply passage is formed inside the drive shaft (40), and the lower end part of the main shaft portion (41) is provided with a centrifugal pump. Refrigeration oil taken from the bottom of the casing (11) by the centrifugal pump is supplied through the oil supply passage of the drive shaft (40) to sliding parts of the compression mechanism (20).

The motor (45) is composed of a stator (46) and a rotor (47). The stator (46) is fixed to the body of the casing (11). The rotor (47) is coupled to the main shaft portion (41) of the drive shaft (40) to rotationally drive the drive shaft (40).

The compression mechanism (20) includes a fixed scroll (21), an orbiting scroll (22) meshing with the fixed scroll (21), and a housing (23) that fixedly supports the fixed scroll (21).

The entire circumference of the housing (23) is joined to the inner surface of the body of the casing (11). This housing (23) is composed of an upper portion (23*a*) and a lower portion (23*b*). The upper portion (23*a*) and the lower portion (23*b*) are integrally formed in top-to-bottom order. A recess is formed in the middle of the upper surface of the upper portion (23*a*). The lower portion (23*b*) forms a generally cylindrical shape having a smaller diameter than the upper portion (23*a*), and projects downwardly from the lower surface of the upper portion (23*a*). The main shaft portion (41) of the drive shaft (40) is inserted into the lower portion (23*b*). The lower portion (23*b*) forms a plain bearing that rotatably supports the main shaft portion (41).

The fixed scroll (21) includes a fixed scroll end plate (21*a*), a fixed scroll wrap (21*b*), and an edge portion (21*c*). The fixed scroll end plate (21*a*) of the fixed scroll (21) has a generally disc shape. The fixed scroll wrap (21*b*) is placed on the lower surface of the fixed scroll end plate (21*a*) to extend vertically, and is formed integrally with the fixed scroll end plate (21*a*). The fixed scroll wrap (21*b*) has the shape of a scroll wall having a fixed height. The edge portion (21*c*) is formed as a wall extending downwardly from an outer edge part of the fixed scroll end plate (21*a*). The entire perimeter of a lower end part of the edge portion (21*c*) projects outwardly. The edge portion (21*c*) is fixed on the top surface of the upper portion (23*a*) of the housing (23).

The orbiting scroll (22) includes an orbiting scroll end plate (22*a*), and an orbiting scroll wrap (22*b*), and a boss (22*c*). The orbiting scroll end plate (22*a*) of the orbiting scroll (22) has a generally disc shape. The orbiting scroll wrap (22*b*) is placed upright on the top surface of the orbiting scroll end plate (22*a*), and is formed integrally with the orbiting scroll end plate (22*a*). The orbiting scroll wrap (22*b*) has the shape of a scroll wall having a fixed height, and meshes with the fixed scroll wrap (21*b*) of the fixed scroll (21). The boss (22*c*) extends downwardly from the bottom surface of the orbiting scroll end plate (22*a*), and is formed integrally with the orbiting scroll end plate (22*a*).

The eccentric portion (42) of the drive shaft (40) is inserted into the boss (22*c*). More specifically, rotation of the drive shaft (40) allows the orbiting scroll (22) to revolve about the center of the main shaft portion (41). The radius of revolution of the orbiting scroll (22) is equal to the eccentricity of the eccentric portion (42), i.e., the distance between the center of the main shaft portion (41) and that of the eccentric portion (42).

The orbiting scroll end plate (22*a*) of the orbiting scroll (22) is located above the upper portion (23*a*) of the housing (23). The boss (22*c*) is located in the recess of the upper portion (23*a*) of the housing (23). Although not illustrated, an Oldham coupling for blocking rotation of the orbiting scroll (22) is disposed between the orbiting scroll end plate (22*a*) of the orbiting scroll (22) and the top surface of the upper portion (23*a*) of the housing (23).

Figure 2:
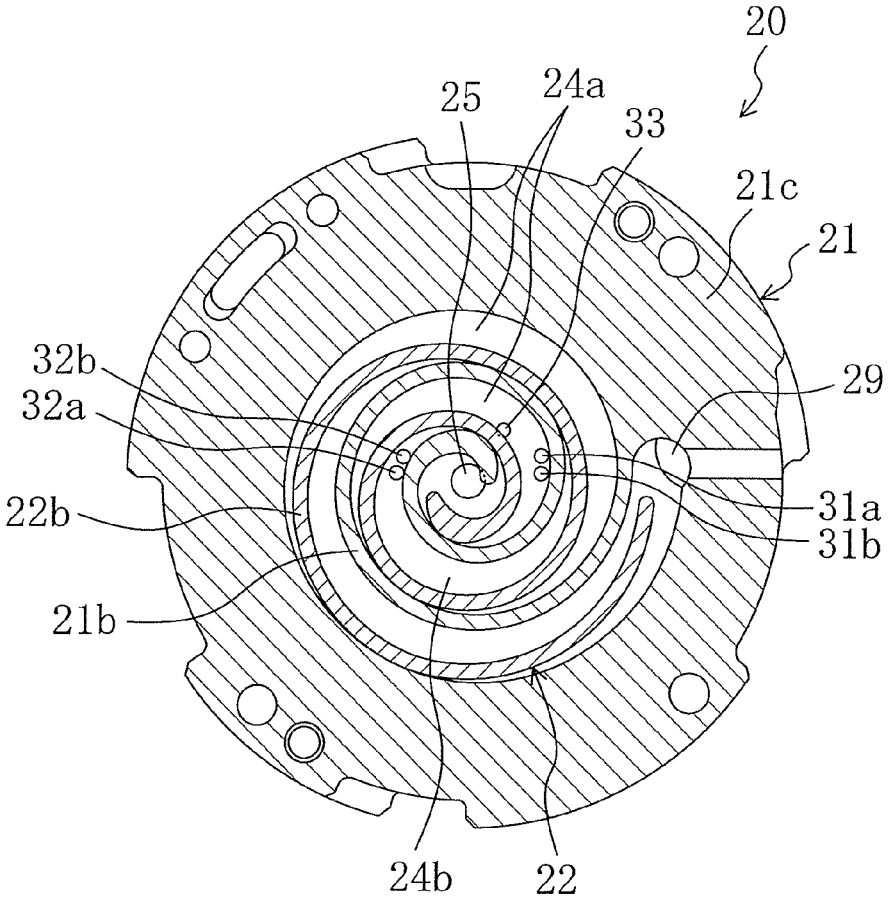
FIG. 2 is a transverse cross-sectional view illustrating an essential part of a compression mechanism according to the embodiment.

As illustrated in FIG. 2, the compression mechanism (20) employs a so-called asymmetric scroll structure. The number of turns of the fixed scroll wrap (21*b*) is different from that of the orbiting scroll wrap (22*b*). More specifically, the fixed scroll wrap (21*b*) is longer than that of the orbiting scroll wrap (22*b*) by approximately one-half turn. An outer end part of the fixed scroll wrap (21*b*) is located in the vicinity of an outer end part of the orbiting scroll wrap (22*b*), and is continuous with the edge portion (21*c*). The fixed scroll wrap (21*b*) and the orbiting scroll wrap (22*b*) each have a constant thickness (wall thickness). More specifically, each of the fixed scroll wrap (21*b*) and the orbiting scroll wrap (22*b*) has a uniform thickness from its outer end part toward its inner end part.

For the compression mechanism (20), the fixed scroll wrap (21*b*) of the fixed scroll (21) meshes with the orbiting scroll wrap (22*b*) of the orbiting scroll (22), thereby defining two compression chambers (24*a*, 24*b*). One of the two compression chambers (24*a*, 24*b*) which is formed between the inner surface of the fixed scroll wrap (21*b*) and the outer surface of the orbiting scroll wrap (22*b*) forms a first compression chamber (24*a*), and the other one thereof which is formed between the outer surface of the fixed scroll wrap (21*b*) and the inner surface of the orbiting scroll wrap (22*b*) forms a second compression chamber (24*b*). In other words, the first compression chamber (24*a*) faces the outer surface of the orbiting scroll wrap (22*b*), and the second compression chamber (24*b*) faces the inner surface of the orbiting scroll wrap (22*b*). The maximum volume of the first compression chamber (24*a*) is greater than that of the second compression chamber (24*b*).

A suction port (29) is formed near the outer periphery of the fixed scroll (21) so as to be connected to the downstream end of the suction pipe (12). Eccentric rotation of the orbiting scroll (22) allows this suction port (29) to intermittently communicate with the compression chambers (24*a*, 24*b*). A cover (27) is attached to the fixed scroll end plate (21*a*) of the fixed scroll (21) to cover the fixed scroll end plate (21*a*). A discharge chamber (28) serving as a discharge space is formed between this cover (27) and the fixed scroll end plate (21*a*). A discharge port (25) that opens to the discharge chamber (28) is formed in the middle of the fixed scroll end plate (21*a*) of the fixed scroll (21). Eccentric rotation of the orbiting scroll (22) allows this discharge port (25) to intermittently communicate with the compression chambers (24*a*, 24*b*). The compression mechanism (20) is configured such that gas refrigerant discharged into the discharge chamber (28) is introduced through a gas passage (not illustrated) into a space below the housing (23) and then discharged through the discharge pipe (13) to the outside of the casing (11).

As illustrated in FIG. 2, the fixed scroll end plate (21*a*) of the fixed scroll (21) is provided with five relief ports (31*a*, 31*b*, 32*a*, 32*b*, 33). The relief ports (31*a*, 31*b*, 32*a*, 32*b*, 33) extend along the thickness of the fixed scroll end plate (21*a*), and their lower ends are open to the compression chambers (24*a*, 24*b*). Openings of the relief ports (31*a*, 31*b*, 32*a*, 32*b*, 33) that are open to the compressors (24*a*, 24*b*) each form a true circular shape. The diameter of each of the openings is smaller than the thickness of the orbiting scroll wrap (22*b*).

The five relief ports (31*a*, 31*b*, 32*a*, 32*b*, 33) are composed of a pair of first relief ports (31*a*, 31*b*), a pair of second relief ports (32*a*, 32*b*), and a single third relief port (33). The two first relief ports (31*a*, 31*b*) are disposed to open near the inner surface of the fixed scroll wrap (21*b*), and are arranged adjacent to each other along the inner surface thereof The lower ends of the first relief ports (31*a*, 31*b*) open to the first compression chamber (24*a*), and the upper ends thereof are connected with the discharge chamber (28). The two second relief ports (32*a*, 32*b*) are disposed to open near the outer surface of the fixed scroll wrap (21*b*), and are arranged adjacent to each other along the outer surface thereof. The lower ends of the second relief ports (32*a*, 32*b*) are open to the second compression chamber (24*b*), and the upper ends thereof are connected with the discharge chamber (28). The single third relief port (33) is disposed to open midway between the inner and outer surfaces of the fixed scroll wrap (21*b*).

Figure 3:
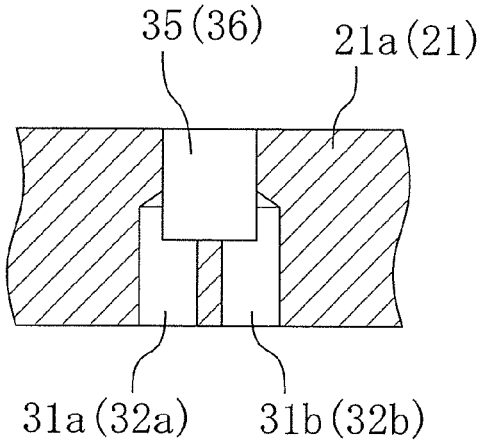
FIG. 3 is a longitudinal cross-sectional view of first or second relief ports of the compression mechanism according to the embodiment and the vicinity of the relief ports.

As illustrated in FIG. 3, a first relief channel (35) is formed in the fixed scroll end plate (21*a*) of the fixed scroll (21) to straddle a part of the fixed scroll end plate (21*a*) between the respective outlet ends of the pair of first relief ports (31*a*, 31*b*). Similarly, a second relief channel (36) is formed in the fixed scroll end plate (21*a*) to straddle a part of the fixed scroll end plate (21*a*) between the respective outlet ends of the pair of second relief ports (32*a*, 32*b*). Each of the relief channels (35, 36) forms a cylindrical shape having a larger diameter than the corresponding relief ports (31*a*, 31*b*, 32*a*, 32*b*). The upper ends of the relief channels (35, 36) are opened in the top surface of the fixed scroll end plate (21*a*), and thus face the discharge chamber (28).

Figure 4:
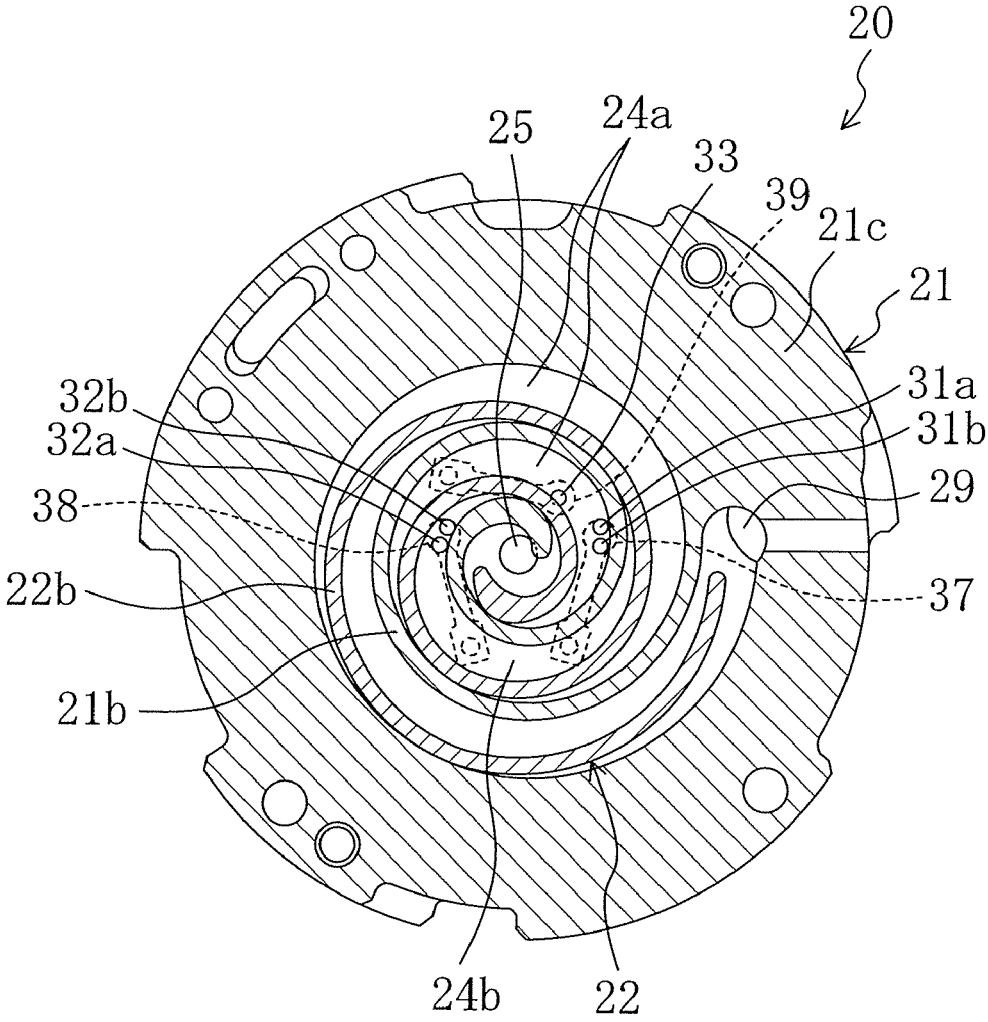
FIG. 4 is a transverse cross-sectional view illustrating an essential part of the compression mechanism according to the embodiment, and also represents lead valves.

As illustrated in FIGS. 1 and 4, first through third lead valves (relief valves (37, 38, 39)) are disposed on the horizontal surface of the fixed scroll end plate (21*a*) defining the discharge chamber (28). The first lead valve (37) can open and close an opening of the first relief channel (35). In other words, the first lead valve (37) can close the pair of first relief ports (31*a*, 31*b*) at the same time. The second lead valve (38) can open and close an opening of the second relief channel (36). In other words, the second lead valve (38) can close the pair of second relief ports (32*a*, 32*b*) at the same time. The third lead valve (39) can open and close an opening of the third relief port (33).

The lead valves (37, 38, 39) each open and close in response to the difference between the pressure of the corresponding compression chamber (24*a*, 24*b*) and the pressure of the discharge chamber (28). More specifically, when, in the compression mechanism (20), the pressure of the interior of the compression chamber (24*a*, 24*b*) during compression is below a predetermined value, the associated lead valve or valves (37, 38, 39) are closed. When the pressure of the interior of the compression chamber (24*a*, 24*b*) during compression is equal to or greater than the predetermined value, the associated lead valve or valves (37, 38, 39) are opened. When any lead valve (37, 38, 39) is opened, refrigerant in the associated compression chamber (24*a*, 24*b*) is delivered through the associated relief ports (31*a*, 31*b*, 32*a*, 32*b*, 33) to the discharge chamber (28). The above-described discharge port (25) is provided without a lead valve. Therefore, the discharge port (25) always faces the discharge chamber (28).

For the compression mechanism (20), eccentric rotation of the orbiting scroll (22) changes the relative positions between the relief ports (31*a*, 31*b*, 32*a*, 32*b*, 33) and the orbiting scroll wrap (22*b*). Here, even with eccentric rotation of the orbiting scroll (22), the first relief ports (31*a*, 31*b*) do not open to the second compression chamber (24*b*). In other words, the first relief ports (31*a*, 31*b*) form relief ports opening only to the first compression chamber (24*a*). Even with eccentric rotation of the orbiting scroll (22), the second relief ports (32*a*, 32*b*) do not open to the first compression chamber (24*a*). In other words, the second relief ports (32*a*, 32*b*) form relief ports opening only to the second compression chamber (24*b*).

Eccentric rotation of the orbiting scroll (22) allows the third relief port (33) to open to both of the first compression chamber (24*a*) and the second compression chamber (24*b*). In other words, eccentric rotation of the orbiting scroll (22) allows the orbiting scroll wrap (22*b*) to reciprocate generally radially while crossing the third relief port (33). As a result, the state of the third relief port (33) changes to the state in which the third relief port (33) is open to the first compression chamber (24*a*), the state in which the third relief port (33) is blocked by the orbiting scroll wrap (22*b*), and the state in which the third relief port (33) is open to the second compression chamber (24*b*) in this order. In other words, eccentric rotation of the orbiting scroll (22) allows the third relief port (33) to open to the first compression chamber (24*a*) and the second compression chamber (24*b*) alternately.

The first relief ports (31*a*, 31*b*) are disposed relatively near the discharge port (25). The first relief ports (31*a*, 31*b*) can open to the first compression chamber (24*a*) communicating with the discharge port (25). More specifically, eccentric rotation of the orbiting scroll (22) allows the first compression chamber (24*a*) to move gradually inwardly and finally communicate with the discharge port (25). The first relief ports (31*a*, 31*b*) are located so as to be connected also with the first compression chamber (24*a*) communicating with the discharge port (25) in the above-mentioned manner.

The second relief ports (32*a*, 32*b*) are disposed relatively near the discharge port (25), and are disposed so as to be opposed to the first relief ports (31*a*, 31*b*) with the discharge port (25) interposed between the first relief ports (31*a*, 31*b*) and the second relief ports (32*a*, 32*b*). The second relief ports (32*a*, 32*b*) can open to the second compression chamber (24*b*) communicating with the discharge port (25). More specifically, eccentric rotation of the orbiting scroll (22) allows the second compression chamber (24*b*) to move gradually inwardly and finally communicate with the discharge port (25). The second relief ports (32*a*, 32*b*) are located so as to be connected also with the second compression chamber (24*b*) communicating with the discharge port (25) in the above-mentioned manner.

The third relief port (33) is disposed relatively near the discharge port (25), and is disposed between the first relief ports (31*a*, 31*b*) and the second relief ports (32*a*, 32*b*). The third relief port (33) is disposed closer to the first relief ports (31*a*, 31*b*) than to the second relief ports (32*a*, 32*b*). Furthermore, the third relief port (33) is disposed in the middle of the fixed scroll (21), i.e., closer to the discharge port (25) than the first relief ports (31*a*, 31*b*) and the second relief ports (32*a*, 32*b*). In other words, the distance from the discharge port (25) to the third relief port (33) is shorter than the distance from the discharge port (25) to each first relief port (31*a*, 31*b*) and the distance from the discharge port (25) to each second relief port (32*a*, 32*b*).

For the compression mechanism (20) of this embodiment, the total volume of void spaces arising from the relief ports (31*a*, 31*b*, 32*a*, 32*b*, 33) is equal to or less than 1% of the suction volume (displacement) of the compression mechanism (20). Specifically, when, in the compression mechanism (20), each lead valve (37, 38, 39) is closed, a void space which does not contribute to refrigerant compression is formed in the relief port (31*a*, 31*b*, 32*a*, 32*b*, 33) or the associated relief channel (35, 36). In other words, in this embodiment, a void space forming a dead volume is formed between the inlet end of the relief port (31*a*, 31*b*, 32*a*, 32*b*, 33) and the associated closed lead valve (37, 38, 39). To address this problem, in this embodiment, the ratio of the sum Vr of the volumes of the void spaces in the relief ports (31*a*, 31*b*, 32*a*, 32*b*, 33) to the suction volume Vs of the compression mechanism (20), i.e., Vr/Vs, is equal to or less than 0.01 in order to minimize performance degradation arising from such void spaces.

Operational Behavior

Next, the principal operational behavior of the above-described scroll compressor (10) will be described.

First, when the motor (45) is driven, the drive shaft (40) rotates, thereby allowing the orbiting scroll (22) to eccentrically rotate relative to the fixed scroll (21). In this case, the rotation of the fixed scroll (21) is stopped by the Oldham coupling.

Figure 5:
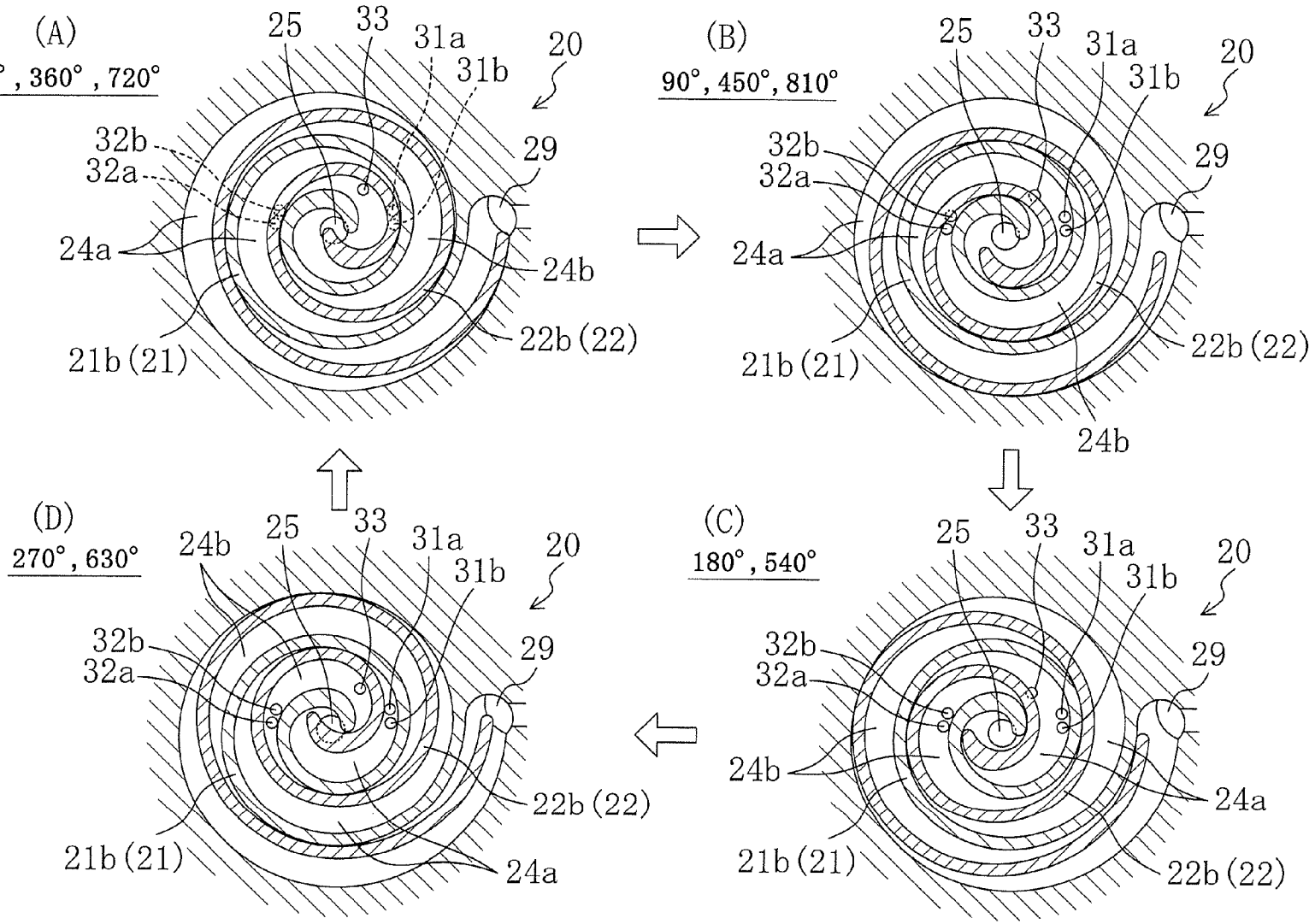
FIG. 5 are transverse cross-sectional views illustrating an essential part of the compression mechanism according to the embodiment to explain eccentric rotation of an orbiting scroll.

As illustrated in FIG. 5, the eccentric rotation of the orbiting scroll (22) allows the volumes of the compression chambers (24*a*, 24*b*) to periodically and repeatedly increase and decrease. Specifically, when the compression chambers (24*a*, 24*b*) increase in volume while communicating with the suction port (29), refrigerant in the refrigerant circuit is sucked into the compression chambers (24*a*, 24*b*). Furthermore, the rotation of the orbiting scroll (22) allows the first compression chamber (24*a*) and the suction port (29) to be blocked. Thus, the outermost portion of the first compression chamber (24*a*) is completely closed (see FIG. 5(A)). Thereafter, the rotation of the orbiting scroll (22) allows the second compression chamber (24*b*) and the suction port (29) to be blocked. Thus, the outermost portion of the second compression chamber (24*b*) is completely closed (see FIG. 5(C)). Thereafter, when the orbiting scroll (22) continues rotating sequentially as illustrated in FIGS. 5(D), 5(A), 5(B), and 5(C), the compression chambers (24*a*, 24*b*) move to the middle of the fixed scroll (21) while decreasing in volume. With this movement, refrigerant in the compression chambers (24*a*, 24*b*) is compressed. When the compression chambers (24*a*, 24*b*) communicate with the discharge port (25), refrigerant in the compression chambers (24*a*, 24*b*) is discharged into the discharge chamber (28). The refrigerant in the discharge chamber (28) is returned through the interior space of the casing (11) and the discharge pipe (13) to the refrigerant circuit.

Relief Operation

Here, an air conditioner may perform an operation (low pressure differential operation) in which the pressure differential between high and low pressure regions of a refrigeration circuit is relatively small, for example, during the intermediate season between summer and winter. In such a low pressure differential operation, a phenomenon in which refrigerant is excessively compressed by a compression mechanism (20), i.e., so-called over-compression, occurs, leading to a decrease in compression efficiency. To address this problem, for the scroll compressor (10) of this embodiment, a relief operation in which refrigerant excessively compressed in each compression chamber (24*a*, 24*b*) is released to the discharge chamber (28) is performed in the low pressure differential operation as described above.

This relief operation will be described hereinafter in detail. The "rotation angle" of the orbiting scroll (22) described below is measured with reference to a 0° position where the outermost portion of the first compression chamber (24*a*) is completely closed as illustrated in FIG. 5(A).

First, a relief operation for the first compression chamber (24*a*) will be described. When the orbiting scroll (22) whose rotation angle is 0° eccentrically rotates, the outermost portion of the first compression chamber (24*a*) gradually decreases in volume, resulting in the refrigerant compressed in the outermost portion of the first compression chamber (24*a*). Consequently, the internal pressure of the outermost portion of the first compression chamber (24*a*) increases.

Figure 6:
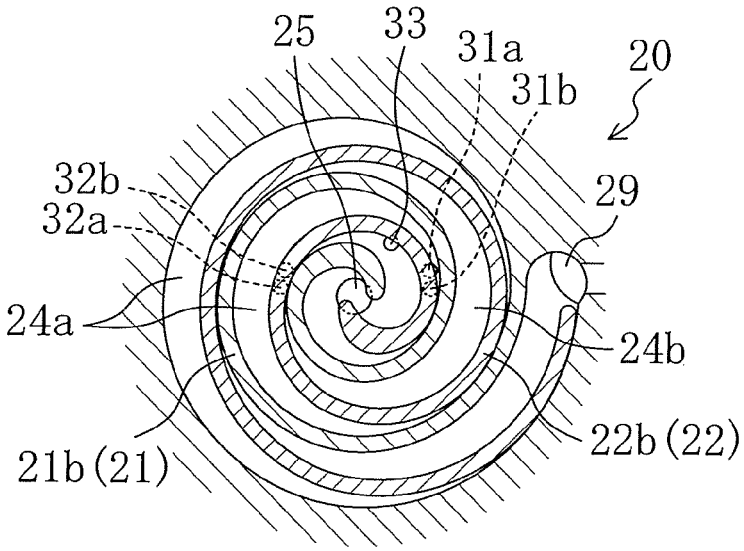
FIG. 6 is a transverse cross-sectional view illustrating an essential part of the compression mechanism according to the embodiment, and represents the situation in which the rotation angle of an orbiting scroll (22) is approximately 370°.
Figure 7:
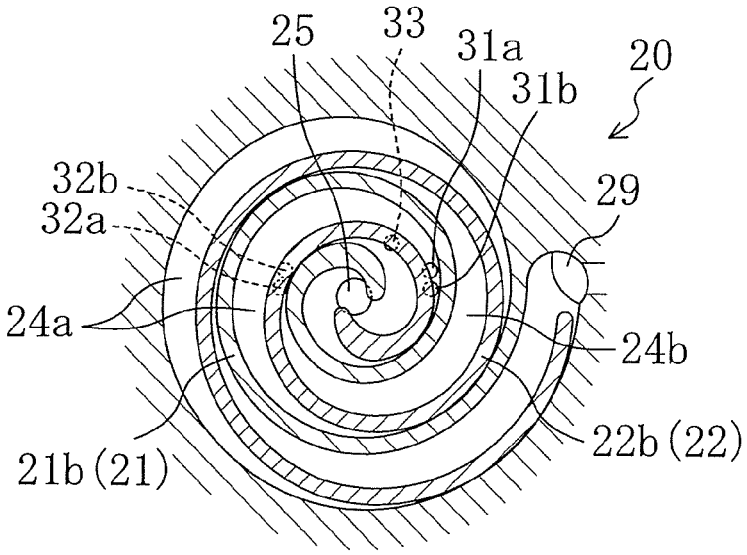
FIG. 7 is a transverse cross-sectional view illustrating an essential part of the compression mechanism according to the embodiment, and represents the situation in which the rotation angle of the orbiting scroll (22) is approximately 390°.

Here, when the rotation angle of the orbiting scroll (22) is in the range of approximately 0° to 360°, the first compression chamber (24*a*) does not yet communicate with the relief ports (31*a*, 31*b*, 33). On the other hand, when the rotation angle of the orbiting scroll (22) exceeds approximately 370°, the inner portion of the first compression chamber (24*a*) starts communicating with one of the first relief ports (31*a*) as illustrated in FIG. 6. Next, when the rotation angle of the orbiting scroll (22) exceeds approximately 390°, the inner portion of the first compression chamber (24*a*) starts communicating with the other first relief port (31*b*) as illustrated in FIG. 7.

In the low pressure differential operation, when the first compression chamber (24*a*) communicates with the first relief ports (31*a*, 31*b*) as described above, the first lead valve (37) is opened as appropriate. As a result, the refrigerant which is being compressed in the first compression chamber (24*a*) is delivered through the first relief ports (31*a*, 31*b*) and the first relief channel (35) to the discharge chamber (28).

Figure 8:
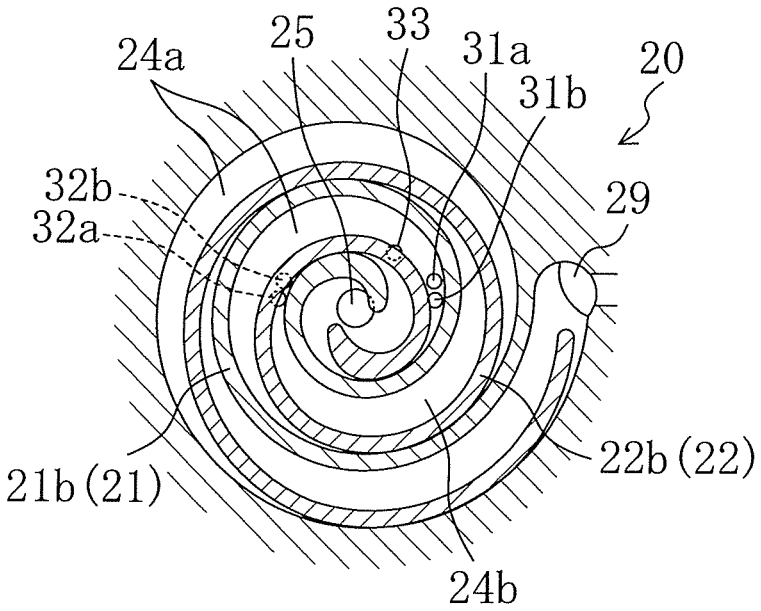
FIG. 8 is a transverse cross-sectional view illustrating an essential part of the compression mechanism according to the embodiment, and represents the situation in which the rotation angle of the orbiting scroll (22) is approximately 420°.

Subsequently, when the rotation angle of the orbiting scroll (22) exceeds approximately 420°, the inner portion of the first compression chamber (24*a*) starts communicating with the third relief port (33) as illustrated in FIG. 8. In the low pressure differential operation, the third lead valve (39) is opened as appropriate in the above-mentioned state. As a result, the refrigerant which is being compressed in the first compression chamber (24*a*) is delivered through the third relief port (33) to the discharge chamber (28).

Figure 9:
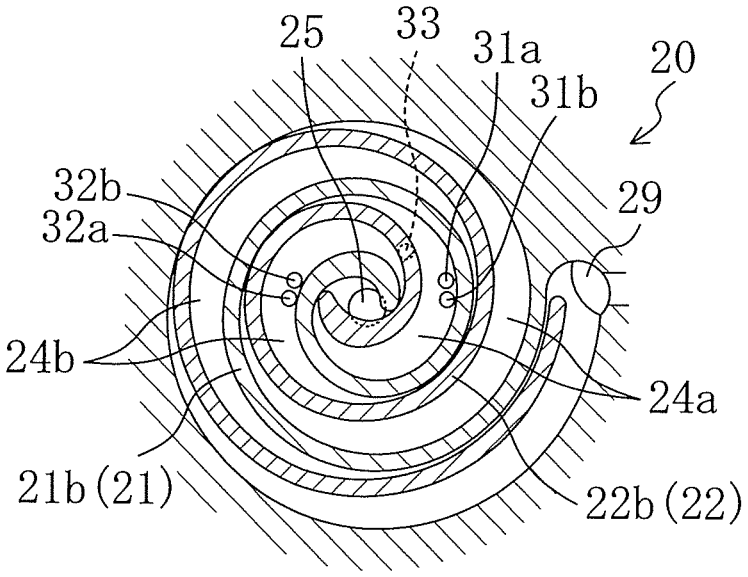
FIG. 9 is a transverse cross-sectional view illustrating an essential part of the compression mechanism according to the embodiment, and represents the situation in which the rotation angle of the orbiting scroll (22) is approximately 570°.

Subsequently, when the rotation angle of the orbiting scroll (22) reaches approximately 570°, the third relief port (33) is blocked by the orbiting scroll wrap (22*b*) as illustrated in FIG. 9. Further rotation of the orbiting scroll (22) from this state allows the third relief port (33) to start communicating with the second compression chamber (24*b*).

Subsequently, when the rotation angle of the orbiting scroll (22) exceeds approximately 620°, the inner portion of the first compression chamber (24*a*) communicates with the discharge port (25), thereby starting the discharge action of the first compression chamber (24*a*). Here, at the beginning of this discharge action, the first relief ports (31*a*, 31*b*) are still connected with the first compression chamber (24*a*) communicating with the discharge port (25) (see, e.g., FIG. 5(D)). Therefore, refrigerant in the first compression chamber (24*a*) is delivered simultaneously through the discharge port (25) and the first relief ports (31*a*, 31*b*) to the discharge chamber (28). Communication between the first relief ports (31*a*, 31*b*) and the first compression chamber (24*a*) terminates when the rotation angle of the orbiting scroll (22) exceeds approximately 700°.

Next, a relief operation for the second compression chamber (24*b*) will be described. Also in the following description, the "rotation angle" of the orbiting scroll (22) is measured with reference to a 0° position where the outermost portion of the second compression chamber (24*b*) is completely closed as illustrated in FIG. 5(A).

When the rotation angle of the orbiting scroll (22) exceeds approximately 160°, the outermost portion of the second compression chamber (24*b*) is completely closed (see, e.g., FIG. 5(C)). When the orbiting scroll (22) eccentrically rotates from the above-described state, the outermost portion of the second compression chamber (24*b*) gradually decreases in volume, resulting in refrigerant compressed in the second compression chamber (24*b*). Consequently, the internal pressure of the outermost portion of the second compression chamber (24*b*) increases.

Here, when the rotation angle of the orbiting scroll (22) is in the range of approximately 0° to 410°, the inner portion of the second compression chamber (24*b*) does not yet communicate with the second relief ports (32*a*, 32*b*). On the other hand, when the rotation angle of the orbiting scroll (22) exceeds approximately 420°, the second relief ports (32*a*, 32*b*) start communicating with the second compression chamber (24*b*) (see, e.g., FIG. 8).

In the low pressure differential operation, when the second compression chamber (24*b*) communicates with the second relief ports (32*a*, 32*b*) as described above, the second lead valve (38) is opened as appropriate. As a result, refrigerant which is being compressed in the second compression chamber (24*a*) is delivered through the second relief ports (32*a*, 32*b*) and the second relief channel (36) to the discharge chamber (28).

Subsequently, after the rotation angle of the orbiting scroll (22) reaches approximately 570° (the state illustrated in FIG. 9), the second compression chamber (24*b*) starts communicating with the third relief port (33). In the low pressure differential operation, the third lead valve (39) is opened as appropriate in the above-mentioned state. As a result, refrigerant which is being compressed in the second compression chamber (24*b*) is delivered through the third relief port (33) to the discharge chamber (28).

Subsequently, after the rotation angle of the orbiting scroll (22) reaches approximately 630° (see, e.g., FIG. 5(D)), the inner portion of the second compression chamber (24*b*) communicates with the discharge port (25), thereby starting the discharge action of the second compression chamber (24*b*). Here, at the beginning of this discharge action, the second relief ports (32*a*, 32*b*) and the third relief port (33) are still connected with the second compression chamber (24*b*) communicating with the discharge port (25). Therefore, refrigerant in the second compression chamber (24*b*) is delivered simultaneously through the discharge port (25) and the second and third relief ports (32*a*, 32*b*, 33) to the discharge chamber (28). Communication between the second relief ports (32*a*, 32*b*) and the second compression chamber (24*b*) terminates when the rotation angle of the orbiting scroll (22) exceeds approximately 730°. Furthermore, communication between the third relief port (33) and the second compression chamber (24*b*) terminates when the rotation angle of the orbiting scroll (22) exceeds approximately 770°.

<Timing of Relief Operation>

Figure 10:
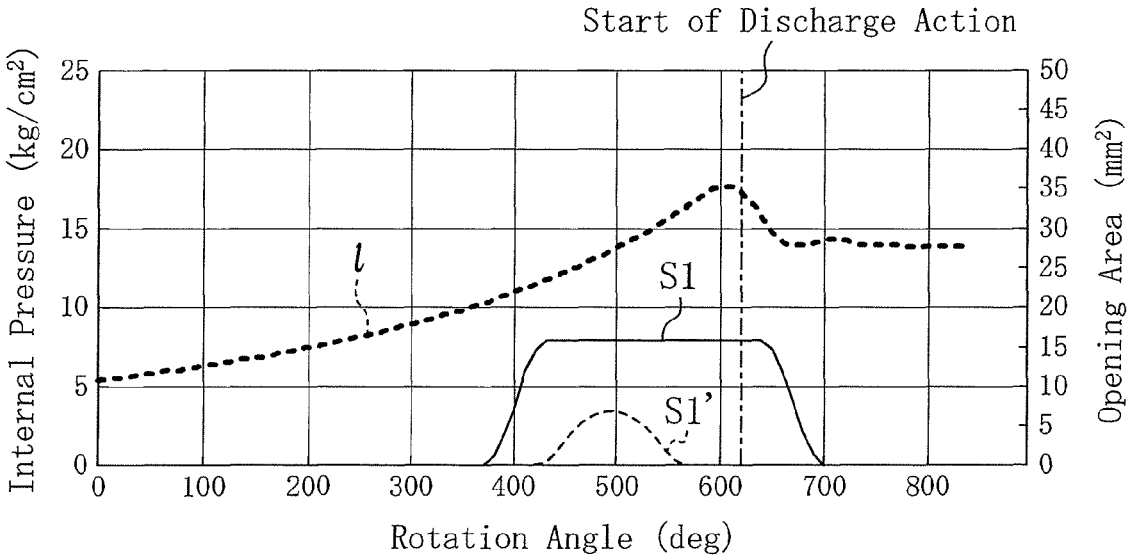
FIG. 10 is a graph illustrating the relationship between the rotation angle of the orbiting scroll of the compression mechanism according to the embodiment, and each of the internal pressure of a first compression chamber and the areas of the openings of corresponding relief ports.
Figure 11:
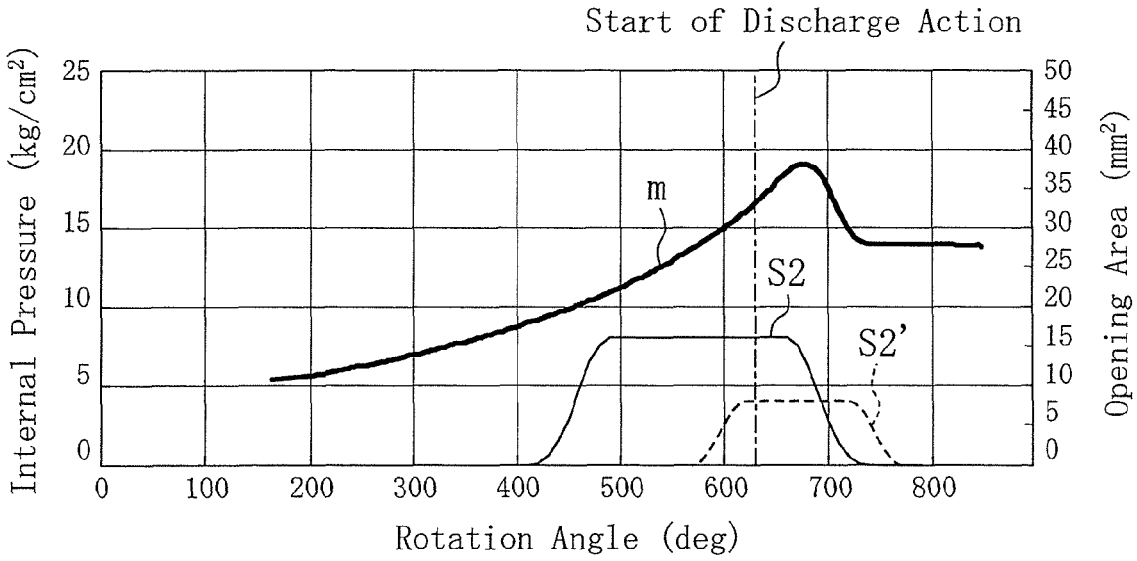
FIG. 11 is a graph illustrating the relationship between the rotation angle of the orbiting scroll of the compression mechanism according to the embodiment, and each of the internal pressure of a second compression chamber and the areas of the openings of corresponding relief ports.
Figure 12:
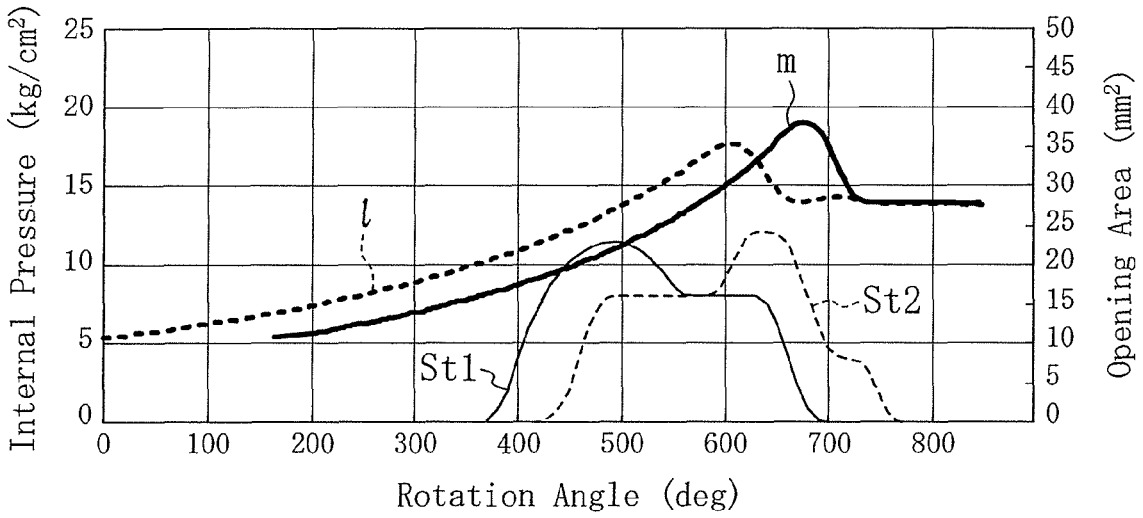
FIG. 12 is a graph illustrating the relationship between the rotation angle of the orbiting scroll of the compression mechanism according to the embodiment, and the internal pressure of each of the first and second compression chambers and the total area of the openings of corresponding relief ports.

The timing of the above-mentioned relief operation will be further described in detail with reference to FIGS. 10-12. FIG. 10 illustrates the following variations with changes in the rotation angle of the orbiting scroll (22): variations in the internal pressure of the first compression chamber (24*a*) during rated operation (the broken line 1); variations in the sum total of the areas of the openings of the first relief ports (31*a*, 31*b*) in the first compression chamber (24*a*) (the solid line S1); and variations in the area of the opening of the third relief port (33) in the first compression chamber (24*a*) (the solid line S1'). FIG. 11 illustrates the following variations with changes in the rotation angle: variations in the internal pressure of the second compression chamber (24*b*) during rated operation (the solid line m); variations in the sum total of the areas of the openings of the second relief ports (32*a*, 32*b*) in the second compression chamber (24*b*) (the solid line S2); and variations in the area of the opening of the third relief port (33) in the second compression chamber (24*b*) (the broken line S2'). Moreover, FIG. 12 illustrates the following variations with changes in the rotation angle: variations in the internal pressures of the compression chambers (24*a*, 24*b*) (the broken line 1 and the solid line m); variations in the sum total of the areas of the openings of the first and third relief ports (31*a*, 31*b*, 33) in the first compression chamber (24*a*) (the solid line St1); and variations in the sum total of the areas of the openings of the second and third relief ports (32*a*, 32*b*, 33) in the second compression chamber (24*b*) (the broken line St2).

As illustrated in FIG. 10, in the first compression chamber (24*a*), a refrigerant discharge action starts when the rotation angle of the orbiting scroll (22) is approximately 620°. On the other hand, the time when the first relief ports (31*a*, 31*b*) communicate with the first compression chamber (24*a*) falls within the range where the rotation angle is approximately 370° through approximately 700°, and the time when the third relief port (33) communicates with the first compression chamber (24*a*) falls within the range where the rotation angle is approximately 420° through approximately 570°. In other words, in the first compression chamber (24*a*), the timing of the discharge action and the timing of each of the relief operations is relatively close to each other. Therefore, relatively high pressure refrigerant is delivered through the first relief ports (31*a*, 31*b*) and the third relief port (33). This enhances the advantage of decompression in the first compression chamber (24*a*), i.e., the advantage of reducing over-compression.

In particular, when the rotation angle is in the range of approximately 620° through approximately 700°, the timing of the relief operation of each of the first relief ports (31*a*, 31*b*) becomes identical with that of the discharge action of the first compression chamber (24*a*). Accordingly, in this range, refrigerant with a pressure similar to the pressure of the refrigerant discharged through the discharge port (25) is delivered through the first relief ports (31*a*, 31*b*). As a result, in this range, over-compression in the first compression chamber (24*a*) is further reduced.

In addition, the range of the rotation angles at which the first relief ports (31*a*, 31*b*) communicate with the first compression chamber (24*a*) straddles the peak (maximum point) of the internal pressure of the first compression chamber (24*a*) (the broken line 1). Therefore, in the range of rotation angles in the neighborhood of the peak, the relief operations of the first relief ports (31*a*, 31*b*) advantageously reduce over-compression.

The range of the rotation angles at which the first compression chamber (24*a*) communicates with the first relief ports (31*a*, 31*b*) is not limited to the above-described range, but is preferably approximately 320° through approximately 750° (approximately −300° through approximately +130° when the timing of the beginning of the discharge action of the first compression chamber is used as the reference (0°)). Furthermore, the range of the rotation angles at which the first compression chamber (24*a*) communicates with the third relief port (33) is not limited to the above-described range, but is preferably approximately 370° through approximately 620° (approximately −250° through approximately 0° when the timing of the beginning of the discharge action of the first compression chamber is used as the reference (0°).

As illustrated in FIG. 11, in the second compression chamber (24*b*), a refrigerant discharge action starts when the rotation angle of the orbiting scroll (22) is approximately 630°. On the other hand, the time when the second relief ports (32*a*, 32*b*) communicate with the second compression chamber (24*b*) falls within the range where the rotation angle is approximately 420° through approximately 730°, and the time when the third relief port (33) communicates with the second compression chamber (24*b*) falls within the range where the rotation angle is approximately 570° through approximately 770°. In other words, also in the second compression chamber (24*b*), the timing of the discharge action and the timing of each of the relief operations is relatively close to each other. Therefore, relatively high pressure refrigerant is delivered through the second relief ports (32*a*, 32*b*) and the third relief port (33). This enhances the advantage of decompression in the second compression chamber (24*b*), i.e., the advantage of reducing over-compression.

In particular, when the rotation angle is in the range of approximately 630° through approximately 770°, the timing of the relief operation of the third relief port (33) becomes identical with that of the discharge action of the second compression chamber (24*b*). Accordingly, in this range, refrigerant with a pressure similar to the pressure of the refrigerant discharged through the discharge port (25) is delivered through the third relief port (33). This further reduces over-compression. In addition, when the rotation angle is in the range of approximately 630° through approximately 730°, the timing of the relief operation of each of the second relief ports (32*a*, 32*b*) and the third relief port (33) becomes identical with that of the discharge action of the second compression chamber (24*b*). This advantageously reduces over-compression.

Moreover, the range of the rotation angles at which the second relief ports (32*a*, 32*b*) communicate with the second compression chamber (24*b*) and the range of the rotation angles at which the third relief port (33) communicates with the second compression chamber (24*b*) both straddle the peak of the internal pressure of the second compression chamber (24*b*) (the broken line m). Therefore, in the range of rotation angles in the neighborhood of the peak, all of the second relief ports (32*a*, 32*b*) and the third relief port (33) further advantageously reduce over-compression.

The range of the rotation angles at which the second compression chamber (24*b*) communicates with the second relief ports (32*a*, 32*b*) is not limited to the above-described range, but is preferably approximately 370° through approximately 780° (approximately −260° through approximately +150° when the timing of the beginning of the discharge action of the second compression chamber is used as the reference (0°). Furthermore, the range of the rotation angles at which the second compression chamber (24*b*) communicates with the third relief port (33) is not limited to the above-described range, but is preferably approximately 520° through approximately 820° (approximately −110° through approximately +190° when the timing of the beginning of the discharge action of the second compression chamber is used as the reference (0°).

As described above, for the compression mechanism (20) of this embodiment, while the relief operation for the first compression chamber (24*a*) and the relief operation for the second compression chamber (24*b*) are performed using the first relief ports (31*a*, 31*b*) and the second relief ports (32*a*, 32*b*), respectively, the relief operations for both the compression chambers (24*a*, 24*b*) are performed using the third relief port (33). Specifically, as illustrated in FIG. 12, for the first compression chamber (24*a*), the total sum of the areas of the openings of the first relief ports (31*a*, 31*b*) and third relief port (33) varies as illustrated by the solid line St1. Thus, relatively high pressure refrigerant is efficiently delivered through these relief ports (31*a*, 31*b*, 33). Furthermore, for the second compression chamber (24*b*), the total sum of the areas of the openings of the second relief ports (32*a*, 32*b*) and third relief port (33) varies as illustrated by the broken line St2. Thus, relatively high pressure refrigerant is efficiently delivered also through these relief ports (32*a*, 32*b*, 33). Here, the third relief port (33) is used for the relief operations of both of the first compression chamber (24*a*) and the second compression chamber (24*b*). This can decrease the total number of relief ports for the compression mechanism (20). Thus, when, for example, during rated operation, refrigerant is compressed with the lead valves (37, 38, 39) closed, the sum total of the volumes of void spaces formed in the relief ports (31*a*, 31*b*, 32*a*, 32*b*, 33) is reduced. This can also reduce the dead volume which does not contribute to compression of refrigerant.

Furthermore, as described above, for the compression mechanism (20) of this embodiment, the ratio Vr/Vs of the sum Vr of the volumes of the void spaces in the relief ports (31*a*, 31*b*, 32*a*, 32*b*, 33) to the suction volume Vs of the compression mechanism (20) (hereinafter referred to as the void volume ratio) is equal to or less than 1%. When the void volume ratio is equal to or less than 1% as described above, this can effectively prevent the efficiency of an air conditioner from being reduced due to the dead volume.

Figure 13:
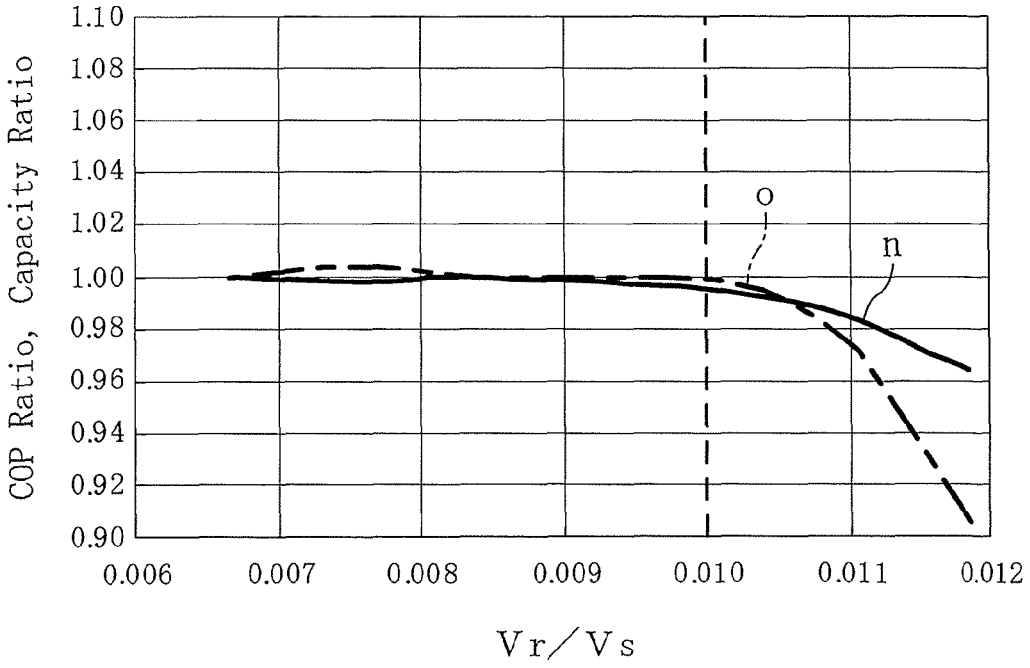
FIG. 13 is a graph illustrating the relationship between the void volume ratio Vr/Vs of the compression mechanism according to the embodiment, and each of the capacity ratio and COP ratio.

This prevention will be described with reference to FIG. 13. FIG. 13 illustrates the results obtained by experimentally determining the relationship between the efficiency of the air conditioner and the void volume ratio. Here, the solid line n in FIG. 13 represents the capacity ratio of an air conditioner, and the alternate long and short dashed lines o therein represent the COP ratio of the air conditioner. Furthermore, in the above-mentioned case, the operating conditions of the air conditioner correspond to standard air conditioning conditions (ARI conditions), and the lead valves (37, 38, 39) are all closed. As apparent from FIG. 13, when the void volume ratio Vr/Vs becomes greater than 1%, the capacity ratio and COP ratio of the air conditioner rapidly decrease. On the other hand, when the void volume ratio is equal to or less than 1% like the compression mechanism (20) of this embodiment, the capacity ratio and COP ratio hardly decrease. In other words, when, in the compression mechanism (20), the void volume ratio is set at 1% or less, high-efficiency operation can be achieved also during rated operation.

ADVANTAGES OF EMBODIMENT

In the above-described embodiment, the following elements are provided: first relief ports (31*a*, 31*b*) opening only to a first compression chamber (24*a*), second relief ports (32*a*, 32*b*) opening only to a second compression chamber (24*b*), a third relief port (33) which can open to both of the compression chambers (24*a*, 24*b*). Excessively compressed fluid is delivered through the relief ports (31*a*, 31*b*, 32*a*, 32*b*, 33). Thus, in the first compression chamber (24*a*), a relief operation can be performed through the first relief ports (31*a*, 31*b*) and the third relief port (33), and in the second compression chamber (24*b*), a relief operation can be performed through the second relief ports (32*a*, 32*b*) and the third relief port (33). In view of the above, a sufficient amount of refrigerant can be delivered from each compression chamber (24*a*, 24*b*), thereby advantageously avoiding over-compression in both the compression chambers (24*a*, 24*b*). Here, the third relief port (33) is used for relief operations for both of the compression chambers (24*a*, 24*b*). This can decrease the number of relief ports as compared with the case where each compression chamber (24*a*, 24*b*) is provided with relief ports. In view of the above, the dead volume arising from the relief ports (31*a*, 31*b*, 32*a*, 32*b*, 33) can be reduced, thereby preventing compression efficiency during rated operation from being reduced. A reduction in the number of relief ports can reduce the number of man-hours and the production cost.

In the above-described embodiment, the first compression chamber (24*a*) connected with the discharge port (25) can communicate with the first relief ports (31*a*, 31*b*). Thus, relatively high pressure refrigerant can be delivered through the first relief ports (31*a*, 31*b*). This can reduce over-compression in the first compression chamber (24*a*). Moreover, in the above-described embodiment, the second compression chamber (24*b*) connected with the discharge port (25) can communicate with the second relief ports (32*a*, 32*b*) and the third relief port (33). Thus, relatively high pressure refrigerant can be delivered through all of the second relief ports (32*a*, 32*b*) and the third relief port (33). This can reduce over-compression in the second compression chamber (24*b*). Since, in particular, the third relief port (33) is disposed in the vicinity of the discharge port (25), this effectively allows the relief operation of the third relief port (33) to reduce over-compression.

In addition, in the above-described embodiment, the first relief ports (31*a*, 31*b*) are disposed adjacent to each other, and the second relief ports (32*a*, 32*b*) are disposed adjacent to each other. A relief channel (35, 36) is disposed to straddle a part of a fixed scroll end plate (21*a*) between each adjacent pair of relief ports (31*a*, 31*b*, 32*a*, 32*b*). The relief channel (35, 36) is opened and closed by the associated lead valve (37, 38). This can reduce the number of lead valves (37, 38). Furthermore, the dead volume can be reduced as compared with the case where relief ports are independently provided. This can more reliably prevent compression efficiency during rated operation from being reduced.

OTHER EMBODIMENTS

The above-described embodiment may be configured as follows.

In the above-described embodiment, a compression mechanism (20) is provided with two first relief ports (31*a*, 31*b*), two second relief ports (32*a*, 32*b*), and a single third relief port (33). However, these relief ports are not restrictive. Specifically, for example, the number of first relief ports and that of second relief ports may be one, and a plurality of third relief ports may be provided. Alternatively, a pair of third relief ports (33) may be disposed adjacent to each other, and a relief channel may be disposed to straddle a part of a fixed scroll end plate (21*a*) between the respective outlet ends of these third relief ports (33) as illustrated in FIG. 3.

The above embodiments are mere essentially preferable examples, and are not intended to limit any scopes of the present invention, applicable subjects, and usage.

INDUSTRIAL APPLICABILITY

As described above, the present invention is useful for an over-compression prevention measure for a scroll compressor.

What is claimed is:

1. A scroll compressor comprising:

a compression mechanism including a fixed scroll having an end plate and a first scroll wrap, an orbiting scroll having a second scroll wrap, the orbiting scroll being eccentrically rotatable relative to the fixed scroll, a first compression chamber facing an outer peripheral surface of the second scroll wrap of the orbiting scroll and a second compression chamber facing an inner peripheral surface of the second scroll wrap of the orbiting scroll being formed by allowing the first scroll wrap of the fixed scroll to mesh with the second scroll wrap of the orbiting scroll, the end plate of the fixed scroll having a discharge port formed in a middle part of the end plate to discharge fluid compressed in the compression chambers to a discharge space, a plurality of relief ports formed outside the discharge port and each having one end open to the associated first or second compression chamber and the other end connected with the discharge space, and relief valves being configured to open and to close an associated relief port of the plurality of relief ports, and the plurality of relief ports having a first relief port configured to open only to the first compression chamber of both the compression chambers, a second relief port configured to open only to the second compression chamber of both the compression chambers, and a third relief port configured to open to the first compression chamber and the second compression chamber alternately due to eccentric rotation of the orbiting scroll, the first relief port being disposed near an inner peripheral surface of the first scroll wrap of the fixed scroll, the second relief port being disposed near an outer peripheral surface of the first scroll wrap of the fixed scroll, and the third relief port being disposed to open midway between the inner and outer peripheral surfaces of the scroll wrap of the fixed scroll.

2. The scroll compressor of claim 1, wherein the first relief port is located to open to the first compression chamber communicating with the discharge port, and the second relief port is located to open to the second compression chamber communicating with the discharge port.

3. The scroll compressor of claim 2, wherein the third relief port is disposed closer to the discharge port than the first relief port and the second relief port.

4. The scroll compressor of claim 2, wherein the end plate of the fixed scroll includes at least one group of multiply adjacent first relief ports, second relief ports, and through third relief ports, a relief channel is formed in the end plate to straddle a part of the end plate between outlet ends of each multiply adjacent pair of relief ports, and a corresponding relief valve of the relief valves is configured to open and to close the relief channel.

5. The scroll compressor of claim 2, wherein a ratio of a total volume of spaces between inlet ends of the relief ports and the associated closed relief valves and a suction volume of the compression mechanism is equal to or less than 0.01.

6. The scroll compressor of claim 1, wherein the third relief port is disposed closer to the discharge port than the first relief port and the second relief port.

7. The scroll compressor of claim 1, wherein the end plate of the fixed scroll includes at least one group of multiply adjacent first relief ports, second relief ports, and third relief ports, a relief channel is formed in the end plate to straddle a part of the end plate between outlet ends of each multiply adjacent pair of relief ports, and a corresponding relief valve of the relief valves is configured to open and to close the relief channel.

8. The scroll compressor of claim 1, wherein a ratio of a total volume of spaces between inlet ends of the relief ports and the associated closed relief valves and a suction volume of the compression mechanism is equal to or less than 0.01.

9. The scroll compressor of claim 1, wherein the first relief port is disposed to open on an inner peripheral surface side of the first scroll wrap of the fixed scroll, the second relief port is disposed to open on an outer peripheral surface side of the first scroll wrap of the fixed scroll.

10. The scroll compressor of claim 9, wherein the first relief port is located to open to the first compression chamber communicating with the discharge port, and the second relief port is located to open to the second compression chamber communicating with the discharge port.

11. The scroll compressor of claim 10, wherein the third relief port is disposed closer to the discharge port than the first relief port and the second relief port.

12. The scroll compressor of claim 10, wherein the end plate of the fixed scroll includes at least one group of multiply adjacent first relief ports, second relief ports, and third relief ports, a relief channel is formed in the end plate to straddle a part of the end plate between outlet ends of each multiply adjacent pair of relief ports, and a corresponding relief valve of the relief valves is configured to open and to close the relief channel.

13. The scroll compressor of claim 10, wherein a ratio of a total volume of spaces between inlet ends of the relief ports and the associated closed relief valves and a suction volume of the compression mechanism is equal to or less than 0.01.

* * * * *